US005094179A

United States Patent [19]

Badillo

[11] Patent Number: 5,094,179

[45] Date of Patent: Mar. 10, 1992

[54] ATTACHABLE LABEL SEWING APPARATUS

[75] Inventor: Paul Badillo, Littleton, Colo.

[73] Assignee: Ralph's Industrial Sewing Machine Company, Denver, Colo.

[21] Appl. No.: 665,019

[22] Filed: Mar. 5, 1991

[51] Int. Cl.[5] ..... D05B 3/00; D05B 21/00

[52] U.S. Cl. ..... 112/114; 112/121.15; 112/265.1; 112/121.12; 112/262.3

[58] Field of Search ..... 112/104, 114, 121.12, 112/265.1, 262.3, 121.15, 103, 102

[56] References Cited

U.S. PATENT DOCUMENTS

| | | | |
|---|---|---|---|
| 3,094,084 | 6/1963 | Hedegaard | 112/104 |
| 3,104,637 | 9/1963 | Hedegaard | 112/104 |
| 3,111,920 | 11/1963 | Hedegaard | 112/104 |
| 4,534,303 | 8/1985 | Off et al. | 112/114 |
| 4,610,210 | 9/1986 | Kinoshita et al. | 112/104 X |
| 4,665,846 | 5/1987 | Takano et al. | 112/121.12 |
| 4,681,048 | 7/1987 | Willenbacher | 112/121.12 X |

FOREIGN PATENT DOCUMENTS

| | | | |
|---|---|---|---|
| 2142589 | 5/1990 | Japan | 112/265.1 |

OTHER PUBLICATIONS

Instruction Book, Model AMS-210A, Needle Lockstitch Computer Control Cycle Machine, published by or on behalf of Tokyo Juki Industrial Co., Ltd., pp. 34-36, (1986-Japan).

*Primary Examiner*—Werner H. Schroeder
*Assistant Examiner*—Paul C. Lewis
*Attorney, Agent, or Firm*—Sheridan Ross & McIntosh

[57] ABSTRACT

An apparatus for attachment to a programmable sewing machine having a sewing needle and an arch clamp assembly for moving a label and a product relative to the sewing needle to effectively attach the label to the product. In one emboiment, the present invention includes an outer clamping device, effectively connected to the arch clamp assembly, which engages the product and moves the product and label in the desired pattern, a clamping plate, also effectively connected to the arch clamp assembly, which firmly secures the label down upon the product, a movable connector between the clamping plate and, effectively, the arch clamp assembly, and a positioning mechanism attached to the programmable sewing machine which mechanically moves the connector between two positions to allow the sewing needle of the programmable sewing machine to "travel" around the entire perimeter of the clamping plate and label. One embodiment of the movable connector assumes a substantially U-shaped configuration. Consequently, when sewing operations are to be initiated, the positioning mechanism places the connector into a position where the sewing needle of the programmable sewing machine may be in the inner cavity thereof. The sewing needle is thus able to exit the connector through the opening to the cavity and "travel" around the perimeter of the clamping plate and label. As the sewing needle nears completion of the 360° pattern, the positioning mechanism moves the connector to its second position such that the sewing needle may again enter the interior cavity thereof to complete the 360° pattern.

21 Claims, 6 Drawing Sheets

ATTACHABLE LABEL SEWING APPARATUS

FIELD OF THE INVENTION

The present invention generally relates to the field of label sewing apparatus and, more particularly, to an attachment for a programmable sewing machine which secures substantially the entire label firmly down upon a given product while allowing for 360° travel of the sewing needle around the perimeter of the label.

BACKGROUND OF THE INVENTION

Labels and other similar tags have long been used to identify, for instance, the manufacturer, fabric type, cleaning instructions, and sizes of various products, including clothing. As manufacturing and efficiency requirements have continued to increase, programmable sewing machines began being utilized to perform certain repetitive portions of the manufacturing process, including label sewing operations. Programmable sewing machines are useful for these types of purposes since numerous sewing patterns may be stored in computer memory and subsequently accessed by an operator to produce a desired design on the given material(s), namely by moving the material(s) relative to the sewing needle with an arch clamp assembly and attached clamping devices which appropriately engage the material(s). Consequently, a sewing pattern which follows the contour of a given label may be stored in computer memory and accessed by the operator after having appropriately positioned the label upon the product. When the program is initiated, the programmable sewing machine sews the desired pattern to appropriately attach the label to the product.

Various clamping devices have been used with arch clamp assemblies to perform the label sewing operations, including square- or rectangularly-shaped clamps having an open interior ("open square clamps"). An upper and lower open square clamp of the described configuration are attached to the arch clamp assembly to engage the product and label therebetween. Once a sewing pattern is entered into the computer memory of the programmable sewing machine which directs the sewing needle to move, relatively, around the interior of the open square clamps to attach the label to the given product, repetitive label sewing operations are achievable.

Although open square clamps utilize the inherent capabilities of the programmable sewing machine, namely its ability to perform repetitive functions in an automated manner, such clamps have a number of existing deficiencies. For instance, the label or tag is only held along its edges by the open square clamps and thus there is a tendency for the label to pull away from between the clamps. This problem is magnified when thin labels are being used. Relatedly, the sewing needle is unable to get very close to the edge of the label since the open square clamps must be able to engage a sufficient amount of the label to avoid the problem of the label pulling out from between the clamps. Consequently, unsecured portions of the label (i.e., those exterior of the sewing pattern) may irritate the user of the product, particularly if the product is an article of clothing. Moreover, since the label is only held along its edges, there is a tendency for the label to "pucker" to a certain degree which is not only aesthetically displeasing, but which may be quite uncomfortable if the label is affixed to an article of clothing. This particular problem is magnified when the label is being sewn onto a product which contains a filler material (i.e., a down-filled jacket), since when the open square clamps are engaged, the filler material tends to bulge up into the open, interior portions thereof.

In recognition of the deficiencies of open square clamps, an alternative was developed for use with programmable sewing machines which firmly secures substantially the entire label against the product. Generally, the alternative clamping device includes an outer, open interior clamping device similar to that described above (i.e., an upper and a lower clamp of the described configuration, but of a larger inner area) which is attached to the arch clamp assembly to engage and move the product relative to the sewing needle to produce the desired pattern thereon. In addition, a solid, appropriately configured clamping plate (i.e., one which follows the contour of the label) is positioned on the interior of the outer clamps and is connected to the arch clamp assembly to firmly secure substantially the entire label down upon the product before sewing operations are initiated. Only a limited amount of the label is exposed so that a sewing pattern may be positioned thereon. Consequently, a sewing pattern is stored in the machine's computer memory which follows the contour of the clamping plate to effectively attach a label around the entire perimeter thereof to a given product.

Although the clamping plate configuration reduces or eliminates puckering of the label and the potential for the label pulling away from the clamping device during operation, a problem existed regarding its connection to the arch clamp assembly. More particularly, a connector had to be developed which would allow the sewing needle to "travel" around the entire perimeter of the clamping plate and label or else the label would not be attached to the product over a defined area. The resultant connector was an invertible, substantially U-shaped connector having a cavity with a single opening thereto. This connector can assume a position such that the sewing needle may be within the cavity and exit through the opening thereto when label sewing operations are initiated. As the sewing needle "travels" around the label and clamping plate and nears completion of the 360° pattern therearound, the connector is inverted such that the sewing needle may again pass through the opening and enter the cavity of the connector to complete the desired full 360° pattern. Thereafter, the sewing needle is raised above the label and product and the threads are cut to terminate the sewing pattern. Furthermore, the connector is inverted back to its original position for subsequent operations and the sewing needle may assume its original position.

Although the U-shaped, invertible connector allows for 360° label sewing operations, the problem with past and existing systems utilizing this device is that a drive assembly (e.g., motor and gear configurations, hydraulic systems, pneumatic systems, solenoids) is incorporated into the programmable sewing machine to actually drive the U-shaped connector between its two described positions. There are a number of deficiencies associated with these driven U-shaped connectors. For instance, the material costs are naturally increased since a separate drive assembly must be installed with the programmable sewing machine. Relatedly, maintenance costs are also increased since there are more components to the label sewing apparatus, and particularly since the U-shaped connector is susceptible to breakage based upon the force which is typically maintained thereon by the drive assembly throughout the entire label sewing operation. Furthermore, in order to take advantage of the capabilities of the programmable sewing machine, i.e., its ability to perform repetitive functions in an automated manner, it is necessary to incorporate the drive assembly within the programmable sewing machine's computer software. Consequently, not only is the drive assembly itself cumbersome and expensive to install, but this required modification of the software is also time consuming and thus expensive. As a result, these systems are usually installed by a field technician versus the owner of the programmable sewing machine and thus are more likely to be designated for this single function due to the typical conversion costs.

Based upon the foregoing, there is a need for a label sewing apparatus which will firmly secure substantially the entire label down upon the product to reduce or eliminate puckering. Furthermore, there is a need for a label sewing apparatus which may be installed on a programmable sewing machine without requiring the assistance of a trained technician, but which still allows the sewing needle to travel the full 360° around the label. Relatedly, there is a need for such a device which does not need a separate drive assembly which must be incorporated into the software of the programmable sewing machine, thereby avoiding increased installation and subsequent maintenance costs.

SUMMARY OF THE INVENTION

The present invention is an attachment for a programmable sewing machine which allows such to be used for sewing labels onto a given product. One embodiment of the present invention generally includes an outer clamping device, effectively connected to the arch clamp assembly of the programmable sewing machine, which engages the product and moves the product and the label relative to the sewing needle to produce the desired pattern thereon, a main clamping plate which firmly secures substantially the entire label down upon the product, and a movable connector between the clamping plate and, effectively, the arch clamp assembly, which allows the sewing needle to travel around substantially the entire perimeter of the label. In one embodiment, this connector is substantially U-shaped and thereby has a cavity and an opening thereto through which the sewing needle may enter to produce a 360° sewing pattern around the label. An important advantage of the present invention is that the movable connector is not driven by a separate drive assembly, but instead mechanically reacts to the movement of the arch clamp assembly relative to the sewing needle to move between two positions. Consequently, there is no need for a complex drive system for the connector which must be incorporated into the computer software, thereby effectively reducing the complexity of installation requirements and associated costs.

Since no separate drive mechanism is required for the movable connector, the present invention utilizes a positioning mechanism located in proximity to the sewing needle to move the connector between the two positions. In order to eliminate any need for structural modification of the programmable sewing machine, the positioning mechanism may be installed in place of the vibrating presser foot of the programmable sewing machine which is typically positioned sufficiently close to the sewing needle for purposes hereof. In one embodiment, the positioning mechanism includes two downwardly extending wires, one being positioned on each side by the sewing needle, to move the connector between the two positions as will be described below. Another embodiment utilizes only a single, downwardly extending wire to move the connector against the force applied thereto by a biasing spring. Consequently, when the wire and the connector are disengaged in this embodiment, the biasing spring moves the connector to a default position such that the two positions of the connector are achieved with only a single wire on the positioning mechanism.

One embodiment of the present invention also includes a support block which is detachably connected to an arch clamp of the arch clamp assembly and the movable connector, the movable connector again being detachably connected to the clamping plate. The support block is then slidably connected to an upper clamp of the outer clamping device utilizing compression springs (i.e., the support block can move vertically relative to the upper clamp). This upper clamp works in combination with an appropriately configured lower clamp to engage materials therebetween. Before engaging the arch clamp assembly to firmly engage the label down upon the product, the product may be inserted between the upper and lower clamps, possibly requiring a slight compression of the springs between the support block and the upper clamp depending upon the vertical position of the support block. When the upper clamp is released, the weight thereof acts upon the product to maintain it in the desired position until the label is appropriately positioned thereon and sewing operations are initiated. The upper clamp may also be configured so as to facilitate the alignment of the product and the label.

Since the present invention does not require a drive mechanism for the movable connector, instead relying upon at least one wire to move the connector between its two positions, it may be necessary for the connector to structurally extend vertically upward a sufficient distance to ensure that the wire(s) of the positioning mechanism will engage and move the connector. Consequently, it may not be possible to "move" the sewing needle "over" the connector after completion of sewing operations as will be described below. Therefore, it may be necessary to utilize the present invention with an electronic programmable sewing machine which has the ability to move bidirectionally (i.e., the sewing needle of these machines may "travel" around the clamping plate in both directions), unlike cam driven machines which may only sew in one direction.

In operation of one embodiment of the present invention when attached in the above manner, the product is positioned under the upper clamp of the outer clamping device and the label is positioned beneath the main clamping plate as described. Sewing operations may then be initiated by first engaging the arch clamp assembly to force the clamping plate and upper clamp (through compression of the springs) down upon the materials and then aligning the sewing needle into its starting position. When the sewing needle is placed in this initial position, one of the wires of the positioning mechanism will move the connector to a first position such that the needle will be within the cavity of the connector. Thereafter, the desired sewing pattern, which follows the perimeter of the label and clamping plate, is used to attach the label to the product by the movement of the arch clamp assembly relative to the sewing needle. More particularly, the sewing needle exits the cavity of the connector through the opening therein. As the needle approaches completing the full 360° pattern around the label and clamping plate, a second wire of the positioning mechanism engages the movable connector and moves it into its second position such that the sewing needle may again enter the cavity of the connector through the opening to complete the full 360° sewing pattern around the label and clamping plate. Thereafter, the sewing needle is raised, the threads are cut, the clamping plate is raised, and the product and label may be removed. The above procedure may then be repeated, but the electronic programmable sewing machine will reverse operations such that the described sewing pattern is performed in the reverse direction (i.e., the sewing needles "travels" around the label and clamping plate in the opposite direction after the label and product have been properly positioned and engaged).

The operation of the alternate embodiment of the positioning mechanism is substantially similar to the above except that the biasing spring moves the connector into one of its two positions and thus effectively replaces, functionally, one of the wires of the positioning mechanism. The remaining single wire therefore moves the connector against the force of the spring to allow the connector to assume a second position.

DETAILED DESCRIPTION

Figure 1:
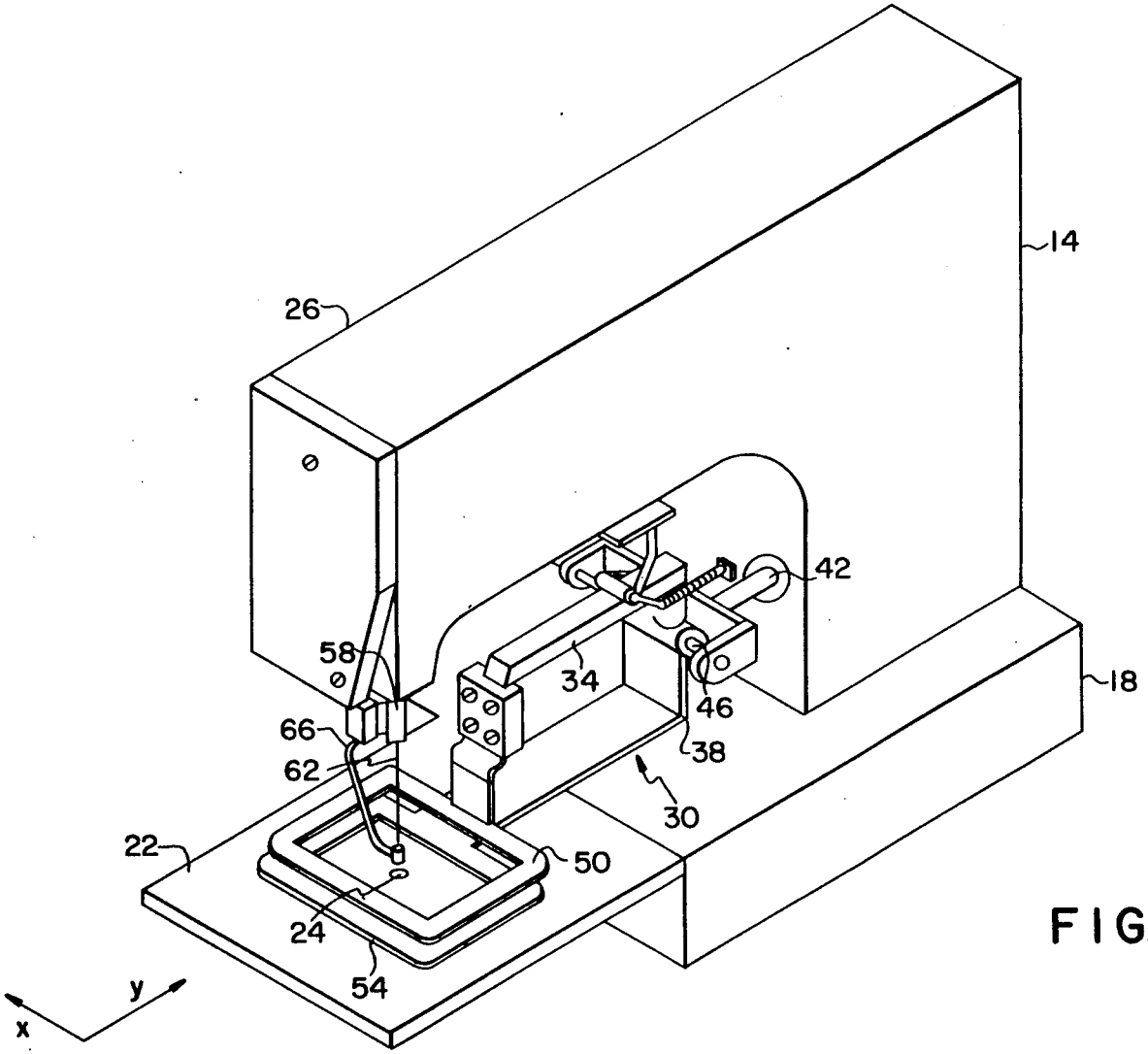
FIG. 1 is a perspective view of an electronic programmable sewing machine utilizing one type of a clamping device.

The present invention will be described with reference to the attached drawings which illustrate the pertinent features thereof. FIG. 1 illustrates a typical electronic programmable sewing machine 14 which, although configured to perform certain sewing operations, may be slightly modified for use with the present invention to more effectively perform label sewing operations. Generally, the programmable sewing machine 14 of FIG. 1 includes a base 18 which supports the machine 14, a head 26 which contains many of the components of the sewing drive assembly (not illustrated) which reciprocates the needle bar 58 and thus the sewing needle 62 in the desired manner, and a cylinder bed 22 which has a needle hole 24 therein for receiving the reciprocating sewing needle 62 to work in conjunction with other sewing components contained therein. The cylinder bed 22 also provides an area to support the materials to be sewn.

A primary advantage of programmable sewing machines 14 is that they are capable of performing repetitive functions in an automated manner. More particularly, sewing patterns may be stored in computer memory (not shown) and accessed by an operator such that a selected sewing pattern will be placed upon the material(s) (not shown) as directed by the computer software (not shown). In this regard, the programmable sewing machine 14 includes an arch clamp assembly 30 which is driven by the computer software. The arch clamp assembly 30 typically includes an arch clamp 34, to which is detachably connected an upper square clamp 50 as is known in the art, and a lower clamp plate 38 which is detachably connected to a movable plate within the casting of the programmable sewing machine 14 (i.e., a plate capable of moving along the x and y axis of the cylinder bed 22) as is known in the art. The arch clamp 34 is also detachably connected to this movable plate, as well as is a lower square clamp 54 as is known in the art. Consequently, the upper square clamp 50, which is able to move vertically relative to the lower square clamp 54 by a slidable connection (not shown) as is known in the art and as directed by the computer software, may be moved to engage and disengage material(s) between the upper and lower square clamps 50, 54. Thereafter, the computer software of the programmable sewing machine 14 may direct the arch clamp assembly 30 to move along the first rod 42 and the second rod 46 such that the sewing needle 62 produces the desired, preselected pattern upon the material(s).

Figure 2:
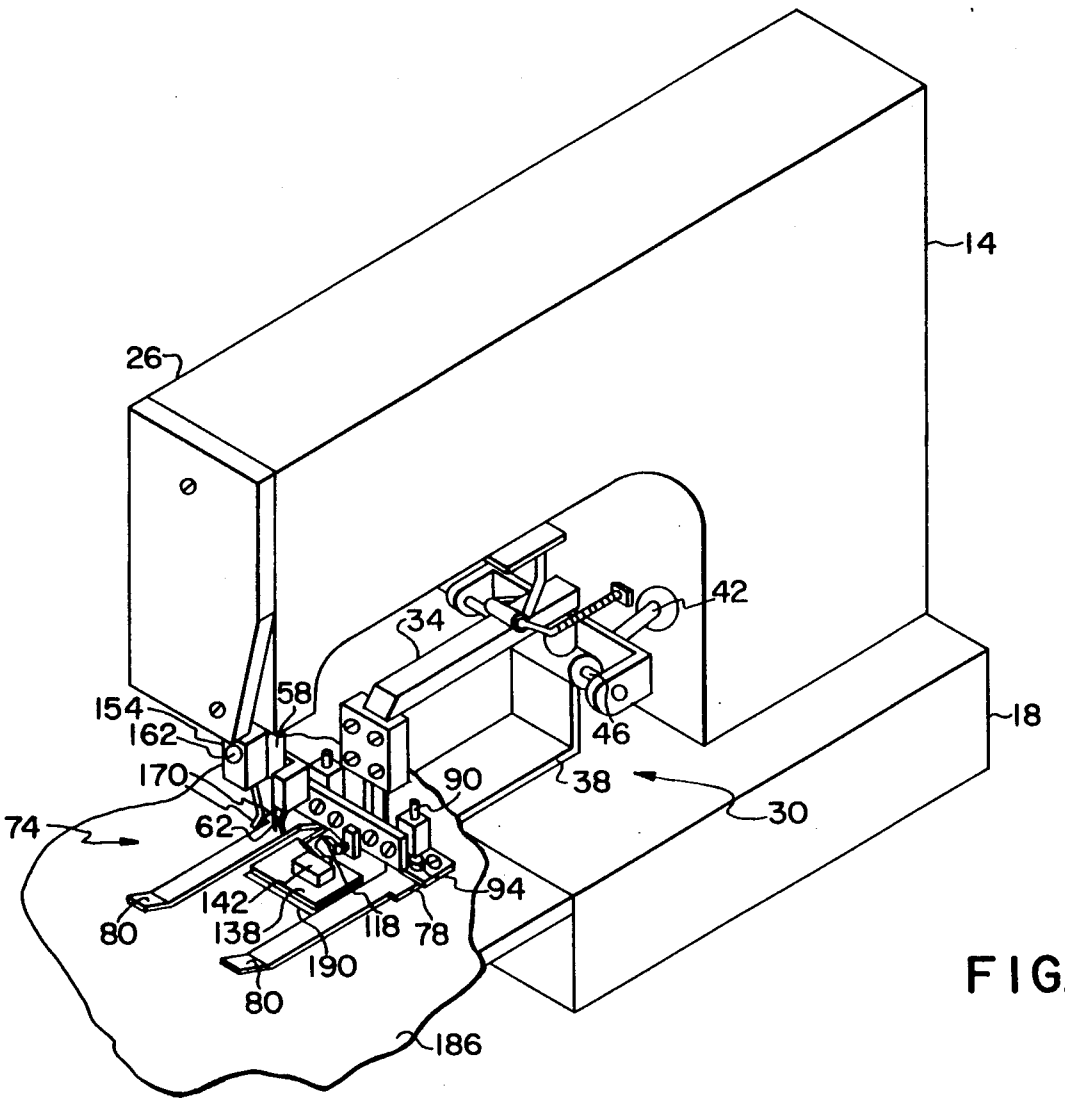
FIG. 2 is a perspective view of an electronic programmable sewing machine with the label sewing apparatus of the present invention attached thereto.

Referring to FIG. 2, the programmable sewing machine 14 has been modified to accommodate installation of the present invention by replacing the upper square clamp 50 with the clamp assembly 74 (again attached to the arch clamp 34 in a manner known in the art) and by replacing the vibrating presser foot 66 of FIG. 1 (commonly used to hold the material(s) down in proximity to the sewing needle 62 to reduce flagging when the sewing needle 62 penetrates the material(s)) with a first positioning mechanism 154. A lower clamp (not shown) which is similar to the lower square clamp 54 of FIG. 1 (i.e., which has portions coinciding with the legs 80 of the outer clamp 78) remains attached to the movable plate (again not shown but as described above) as is well known in the art so that materials may be engaged and disengaged by the clamp assembly 74. Consequently, the programmable sewing machine 14 may then effectively attach a label 190 to a given product 186 in a manner which does not require modifying the drive mechanism or the software of the programmable sewing machine 14, but which still results in an attached label 190 which remains substantially flat upon the product 186 and which is attached to the product 186 around substantially the entire perimeter of the label 190.

Figure 3:
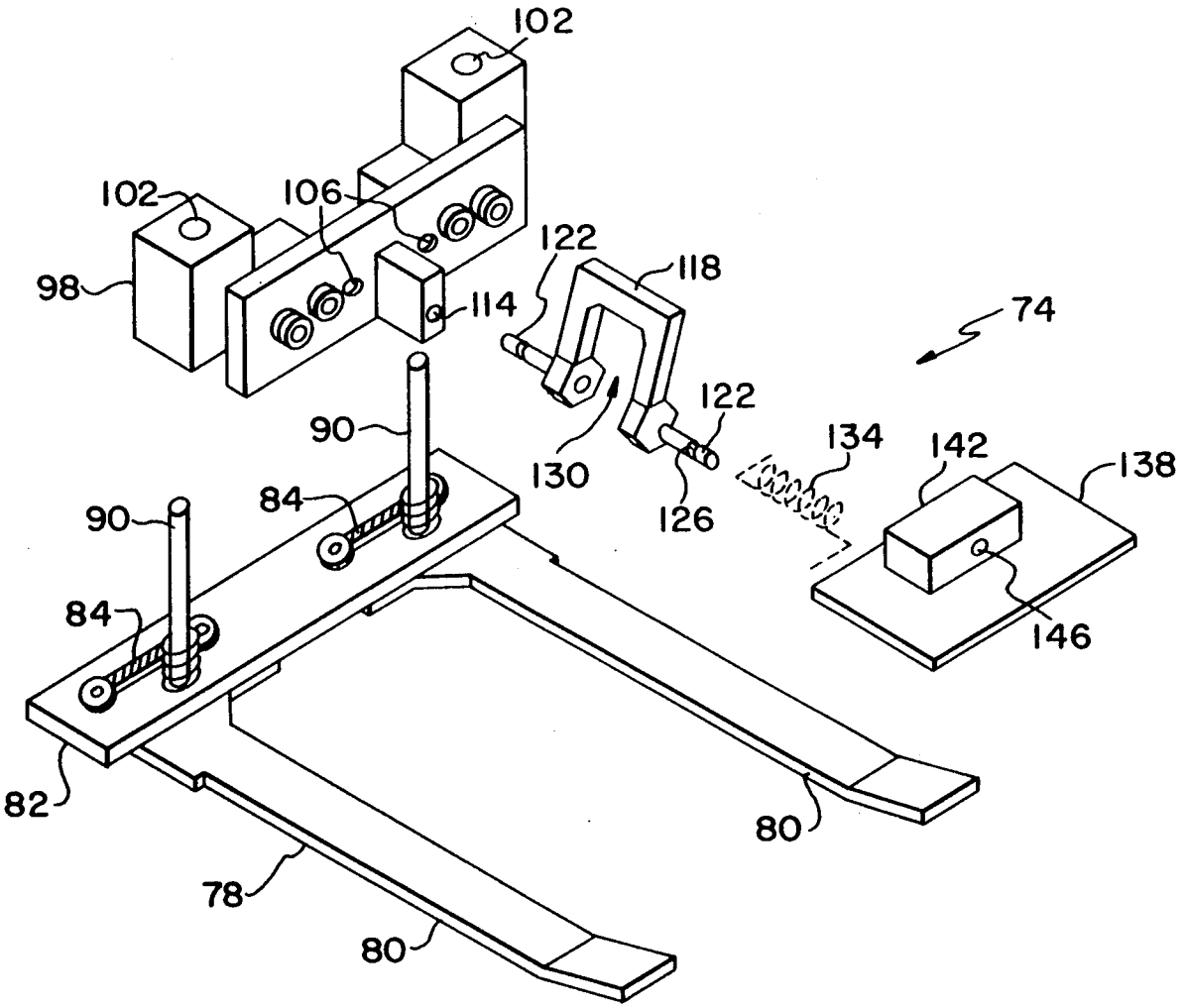
FIG. 3 is an exploded, perspective view of the clamp assembly portion of the present invention.
Figure 5:
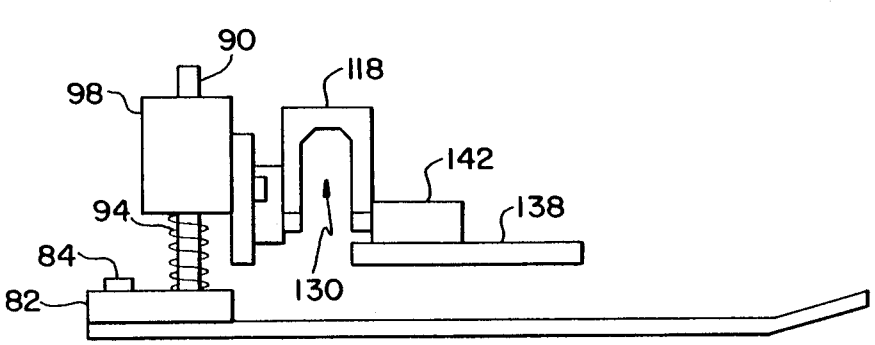
FIG. 5 is a side view of the assembled clamp assembly of FIG. 3.
Figure 6:
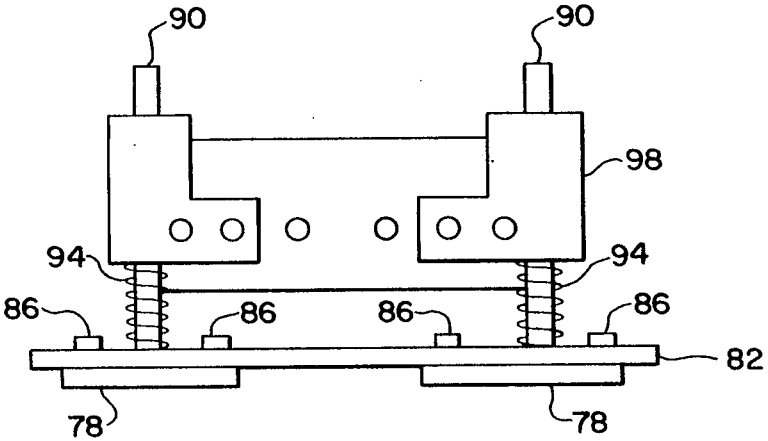
FIG. 6 is a back view of the assembled clamp assembly of FIG. 3.

The clamp assembly 74 portion of the present invention moves the product 186 and the label 190 relative to the sewing needle 62 in a manner which allows for the full 360° travel of the sewing needle 62 around the label 190 and which results in a label 190 which remains substantially flat upon the product 186. The primary components of one embodiment of the clamp assembly 74 of the present invention are illustrated in FIGS. 3–6. Referring to FIG. 3, the clamp assembly 74 generally includes a support block 98 which is connected to the arch clamp 34 in a manner known in the art, an adjustable outer clamp 78 which engages and moves the product 186 upon which the label 190 is to be sewn relative to the sewing needle 62 as directed by the computer software of the programmable sewing machine 14, together with an appropriately configured lower clamp (not shown) similar to the lower square clamp 54 of FIG. 1 (i.e., one having portions which coincide with the legs 80), a clamping plate 138 positioned between the legs 80 of the outer clamp 78 which firmly secures the label 190 down upon the product 186, and a movable connector 118 which connects the clamping plate 138 to the support block 98.

The support block 98 establishes the connection between the clamp assembly 74 and the arch clamp assembly 30 of the programmable sewing machine 14. In this regard, there are a pair of mounting bores 106 through which extensions or forks (not shown) from the arch clamp 34 may be inserted and secured thereto by screws. Furthermore, the support block 98 includes a pair of post bores 102 which establish a desirable slidable connection with the outer clamp 78 as will be discussed below.

Figure 4:
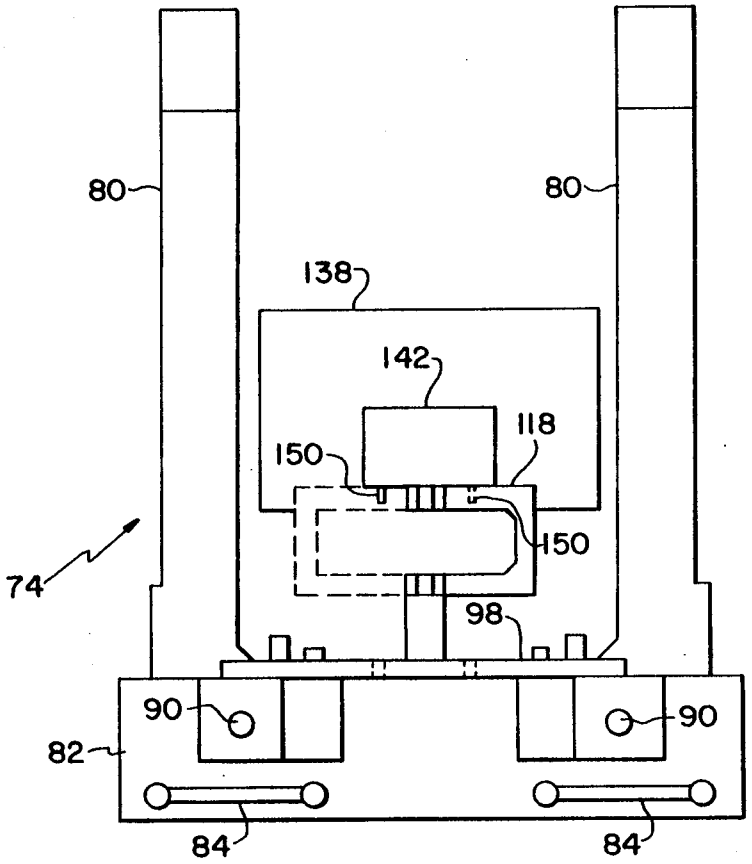
FIG. 4 is a top view of the assembled clamp assembly of FIG. 3.

The primary functions of the outer clamp 78 are to assist in aligning the label 190 upon the product 186 and to work in conjunction with an appropriately configured lower clamp (i.e., one which has portions which coincide with the legs 80) to engage and move the product 186, as well as the label 190 when secured thereto, relative to the sewing needle 62 such that a pattern is sewn around the perimeter of the clamping plate 138 and the label 190 which thereby appropriately secures the label 190 to the product 186. In order to allow the outer clamp 78 to be used with a variety of sizes of clamping plates 138 (i.e., the size of the clamping plate 138 is a function of the size of the particular label 190), the outer clamp 78 is adjustable as best illustrated in FIGS. 3–4. In this regard, a slide plate 82 with a pair of slots 84 therein is positioned above the end of the outer clamp 78 such that the distance between the legs 80 of the outer clamp 78 may be adjusted. Slide plate screws 86 may then be appropriately engaged to fix the desired distance between the legs 80. As noted above and as will be discussed in more detail below, a pair of posts 90 with compression springs 94 positioned therearound (FIGS. 3, 5, and 6) are affixed to the upper surface of the slide plate 82 for purposes of establishing the slidable connection between the outer clamp 78 and the support block 98.

The clamping plate 138 is positioned between the legs 80 of the outer clamp 78 and it functions to firmly secure a label 190 down upon a product 186 to reduce the amount of puckering in the label 190 when attached. In this regard, the clamping plate 138 should be configured in the shape of the label 190 to be sewn, but should be slightly smaller than the label 190 such that when the clamping plate 138 is moved relative to the sewing needle 62 (discussed below), the sewing needle 62 may travel around the clamping plate 138 to engage the label 190 and the product 186.

In order to allow the present invention to be used with programmable sewing machines 14 and to fully utilize its capabilities in performing label sewing operations, the present invention also includes a movable connector 118 to establish the connection between the support block 98 and the clamping plate 138. The connector is substantially U-shaped with oppositely positioned mounting posts 122 having grooves 126 thereon which snap into engagement with a connector bore 114 on the support block 98 and a mounting bore 146 positioned in a mounting block 142 fixedly attached to the top of the clamping plate 138. The configuration of the connector 118 is such that it has a cavity 130, which when the connector 118 is moved between its two positions (discussed below) allows the sewing needle 62 to travel around the entire perimeter of the clamping plate 138 to allow the label 190 to be attached to the product 186 around its entire perimeter. In order to limit the range of motion of the movable connector 118 to ensure that the positioning mechanism (discussed below) will engage and move the connector 118 between its two positions, a pair of pins 150 are positioned on the edge of the mounting block 142 as illustrated in FIG. 4.

A key aspect of the present invention is that the described clamp assembly 74 allows labels 190 to be sewn upon given products 186 without requiring the need to incorporate a separate drive mechanism for the movable connector 118, and thus eliminates the need to program the computer software accordingly. Instead, the present invention utilizes the relative motion between the clamping plate 138 and thus the connector 118, through movement of the arch clamp assembly 30, and the sewing needle 62 to mechanically move the connector 118. In this regard, the present invention includes a positioning mechanism, one embodiment of which is illustrated in FIGS. 7–8.

Figure 7:
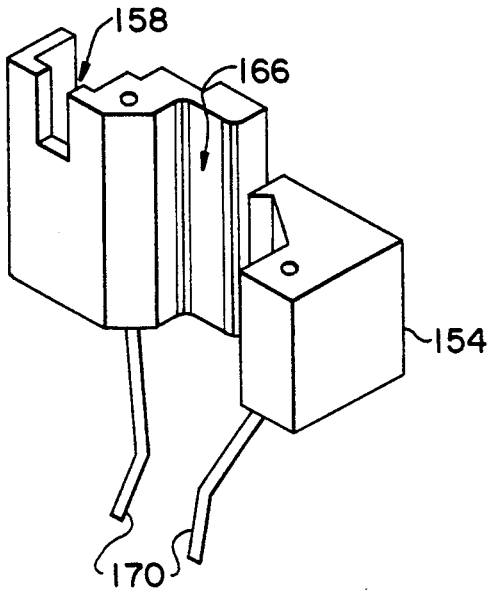
FIG. 7 is a perspective view of one embodiment of the positioning mechanism portion of the present invention.
Figure 8:
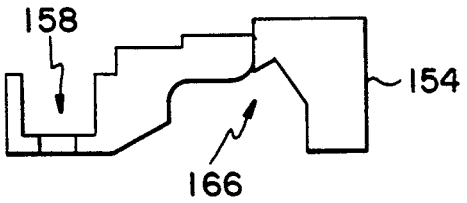
FIG. 8 is a top view of the positioning mechanism of FIG. 7.
Figure 12:
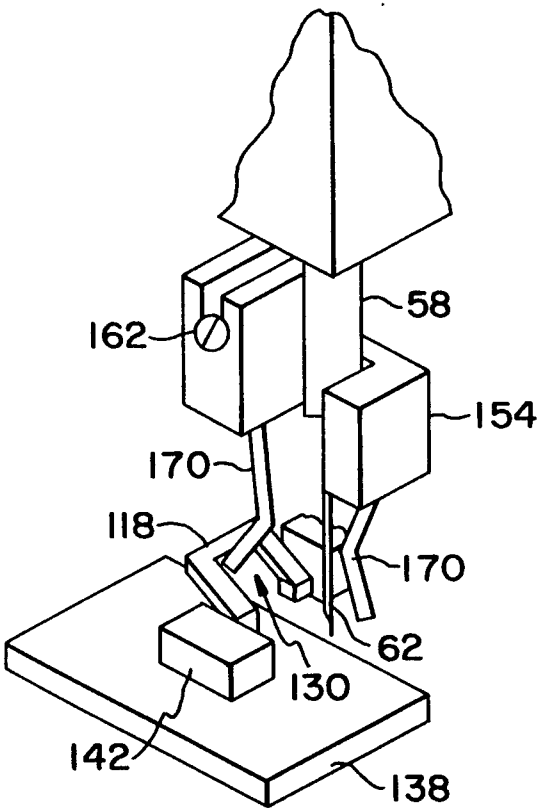
FIG. 12 is a perspective view of one embodiment of the movable connector portion of the present invention in a second position.
Figure 11:
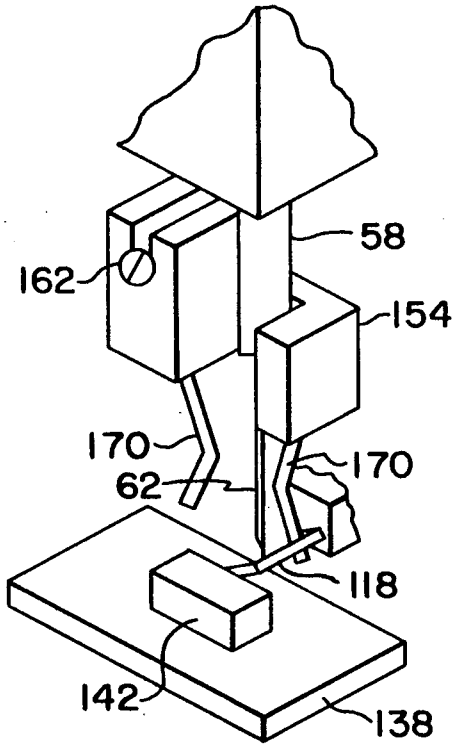
FIG. 11 is a perspective view of one embodiment of the movable connector portion of the present invention in a first position.

The first positioning mechanism 154 of FIGS. 7–8 generally includes two first wires 170, one being positioned on each side of the sewing needle 62 as illustrated in FIGS. 2 and 11–12, to move the connector 118 between its two positions. In order to ensure that contact is established between the first wire 170 and the connector 118, each first wire 170 may have a certain curvature. Although the first positioning mechanism 154 may be attached to the programmable sewing machine 14 in a number of locations such that the first wires 170 will be positioned on opposite sides of the sewing needle 62 in proximity thereto, the first positioning mechanism 154 may replace the vibrating presser foot 66 (FIG. 1) of the programmable sewing machine 14 which will therefore not necessitate any structural modification of the programmable sewing machine 14 in order to utilize the present invention. The vibrating presser foot 66 (FIG. 1) typically vertically reciprocates. The first positioning mechanism 154 may be used with the reciprocating motion provided by the driver (not shown) of the vibrating presser foot 66 or the driver may be disabled such that the first positioning mechanism 154 remains substantially stationary throughout operation.

For purposes of attaching the first positioning mechanism 154 to the presser bar (not shown) of the vibrating presser foot 66, the first positioning mechanism 154 includes a presser bar mounting cavity 158 into which the presser bar is inserted. A screw 162 (FIG. 2) may then slide within the illustrated cavity and engage with the presser bar (not shown) to establish the connection therebetween. The first positioning mechanism 154 also includes a needle bar cavity 166 which allows the sewing needle 62 to extend down and reciprocate therethrough to sew the desired pattern upon the label 190 and product 186.

Figure 9:
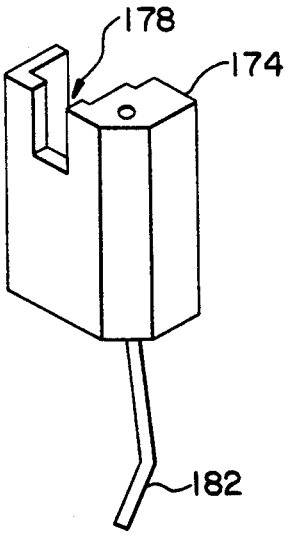
FIG. 9 is a perspective view of another embodiment of the positioning mechanism portion of the present invention.
Figure 10:
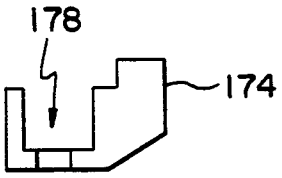
FIG. 10 is a top view of the positioning mechanism of FIG. 9.

Another embodiment of an appropriate positioning mechanism is illustrated in FIGS. 9–10. The second positioning mechanism 174 is substantially similar to that of the embodiment of FIGS. 7–8 except that it includes only a single second wire 182 and thus eliminates the need for any type of cavity through which the sewing needle 62 may pass. This is achievable since a biasing spring 134 (indicated by dashed lines in FIG. 3) acts upon appropriate surfaces of the connector 118 to bias the connector 118 into one position against one of the pins !50 (FIG. 4). This default orientation of the connector 118 is a result of the forces exerted thereon by the biasing spring 134 and would be that generally illustrated in FIG. 11. Consequently, the biasing spring 134 places the connector 118 into one position (such as that illustrated in FIG. 11), while the second wire 182 will contact the connector 118 and act against the force of the biasing spring 134 to place the connector 118 into a second position (such as that illustrated in FIG. 12), as will be discussed below.

In operation of one embodiment, the present invention will be attached to the programmable sewing machine as generally illustrated in FIG. 2 by replacing the upper square clamp 50 with the clamp assembly 74 and the vibrating presser foot 66 (FIG. 1) with the first positioning mechanism 154 as described above. The lower square clamp 54 (FIG. 1) may also need to be replaced so that the legs 80 of the outer clamp 78 will coincide with portions thereof. The product 186 and the label 190 may then be positioned between the outer clamp 78 and the clamping plate 138 and the lower square clamp 54 into the desired position. Again, the compression springs 94 are used between the slidable connection of the outer clamp 78 and the support block 98 to facilitate the positioning and alignment procedure. More particularly, when this particular configuration is utilized, the arch clamp assembly 30 may be positioned such that the clamping plate 138 is not exerting a substantial force down upon the label 190. However, since the outer clamp 78 is freely and slidably engaged with the support block 98, the compression springs 94 may be upwardly compressed, if required, to allow for insertion of the product 186 under the outer clamp 78 and the upper clamp 78 may then be released after the product 186 is appropriately positioned. Thereafter, the product 186 will be held in place by the weight being exerted thereon by the outer clamp 78.

Once the product 186 and label 190 have been appropriately positioned, the arch clamp assembly 30 may be activated such that the clamping plate 138 and the outer clamp 78, through compression of the springs 94, will engage the label 190 and product 186 respectively. The sewing needle 62 may then be placed into its initial position before beginning sewing operations such as illustrated in FIG. 11. When placed into this position, one of the first wires 170 will engage the connector 118 to place it into a first position, the range of motion of the connector 118 again being limited by one of the pins 150 (FIG. 4). Moreover, the sewing needle 62 will extend down though the cavity 130 of the connector 118 such that a complete 360° pattern may be sewn around the label 190.

After the above initialization procedure has been completed, the operator of the programmable sewing machine 14 initiates the program which controls sewing operations. The arch clamp assembly 30 moves along the first and second rods 42, 46 in the desired pattern such that the sewing needle 62 exits the cavity 130 of the connector 118 and closely follows the edge of the clamping plate 138 to attach the label 190 to the product 186. As the sewing needle 62 nears completion of its path around the entire perimeter of the clamping plate 138 and the label 190, the second of the first wires 170 engages the connector 118 to move the opening to the cavity 130 such that the sewing needle 62 may again enter therein to complete the full 360° pattern as illustrated in FIG. 12. Thereafter, the sewing needle 62 is raised, the threads are cut, the clamp assembly 74 is raised, and the label 190 and product 186 may be removed.

Since the connector 118 may have to extend vertically above the cylinder bed 22 a sufficient distance to ensure that the first wires 170 will contact and move the connector 118, it may not be possible to move the retracted sewing needle 62 "over" the connector 118 back to its original position. In order to avoid this potential problem, the present invention may be used with an electronic programmable sewing machine capable of sewing bidirectionally around the clamping plate 138. Consequently, the connector 118 could remain in the above-described position and a new product 186 and label 190 could be positioned as described above. Upon initiation of sewing operations as described above, the programmable sewing machine's 14 computer software would direct the arch clamp assembly 30 to reverse its direction such the sewing needle 62 would "travel" around the clamping plate 138 in the opposite direction such that the sewing needle 62 would end up back in the position illustrated in FIG. 11.

The operation of the present invention utilizing the second positioning mechanism 174 is substantially similar to the above except that the biasing spring 134 (FIG. 3) essentially functions as one of the first wires 170 by placing the connector 118 into one position when the second wire 182 is not exerting a force thereon. In the configuration of the second positioning mechanism 174 presented herein, the biasing spring 134 would place the connector 118 into the position it assumes in FIG. 11, while the second wire 182 would place the connector 118 into its FIG. 12 orientation.

The present invention has been described herein as being useful with a single stage programmable sewing machine. With single stage machines, there is only a single independent downward movement of the arch clamp assembly. Consequently, the present invention was described as being of a configuration which accommodated for this "limitation." However, it can be appreciated that the present invention may also be used with a two-stage programmable sewing machine. A two-stage machine provides the capabilities of having two separate downward movements for the arch clamp assembly. In these instances, the clamping plate 138 would be effectively connected to one driver (i.e., through the support block 98), while the outer clamp 78 would be attached to the second downward driver. Consequently, after the product was properly positioned, the outer clamp 78 would be engaged to secure the product. Thereafter, upon proper positioning of the label, the second driver of the programmable sewing machine would be engaged to force the clamping plate 138 down upon the label. Label sewing operations would then continue as described above.

It should be appreciated that it may be desirable to utilize a retractable positioning mechanism using, for example, a solenoid-activated system. In this case, in accordance with the above, the positioning mechanism would be normally spaced from the connector 118 and it would only contact the connector 118 when a change in position of the connector 118 was required. However, such an embodiment would be relatively more complicated, would require additional parts, and would not be as cost effective as the previously described embodiment.

The foregoing description of the invention has been presented for purposes of illustration and description. Further, the description is not intended to limit the invention to the form disclosed herein. Consequently, variations and modifications commensurate with the above teachings, and the skill and knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended claims be construed to include alternative embodiments to the extent permitted by the prior art.

What is claimed is:

1. An apparatus used with a sewing machine for sewing labels on a fabric using a sewing needle, comprising:
first means for engaging and moving fabric;
second means connected to said first means for clamping a label to be sewn to the fabric;
third means interconnecting said first and second means; and
fourth means spaced from said third means during most of the sewing of the label to the fabric, said fourth means including at least a portion for engaging said third means, wherein said third means moves due to engagement with said fourth means to permit the sewing needle to sew parts of the label to the fabric.

2. An apparatus, as claimed in claim 1, wherein:
said third means includes at least a pivotable portion and wherein said fourth means includes at least one projecting member for contacting said third means to cause said pivotable portion to pivot.

3. An apparatus, as claimed in claim 2, wherein:
the sewing machine includes a removable vibrating presser foot and said projecting member is connected to the sewing machine at substantially the same position as the vibrating presser foot after it has been removed from the sewing machine.

4. An apparatus, as claimed in claim 1, wherein:
said third means includes a flipper arm that is free of connection to a source of power during the entire operation of the apparatus.

5. An apparatus, as claimed in claim 1, wherein:
said first means includes a single power source for moving said second and third means and is the only power source required for the fourth means to move said third means.

6. An apparatus, as claimed in claim 1, wherein:
said first means includes a power source for moving said second means and said same power source is used to move said third means by causing said third means to engage said fourth means during movement of said second means and said third means.

7. An apparatus, as claimed in claim 1, wherein:
said fourth means includes rod means extending in a substantially vertical direction and in which said rod means does not move past said third means when said rods means engages said third means.

8. An apparatus, as claimed in claim 7, wherein:
said rod means includes first and second spaced rods in which said first rod engages said third means when said third means is moving in a first direction and said second rod engages said third means when said third means is moving in a second direction.

9. An apparatus, as claimed in claim 7, wherein:
said rod means includes a rod and said third means includes biasing means, wherein said third means returns to a home position after disengagement between said rod and said third means.

10. An apparatus, as claimed in claim 7, wherein:
said rod means remains substantially stationary relative to other portions of said fourth means during engagement between said rod means and said third means.

11. An apparatus, as claimed in claim 1, wherein:
said third means includes a substantially U-shaped flipper arm having an open area and wherein portions of said fourth means are disposed in said open area, together with portions of the sewing needle, after said fourth means pivots said flipper arm.

12. An apparatus, as claimed in claim 1, wherein:
said first means includes fifth means for contacting the fabric and sixth means for moving said fifth means relative to the fabric.

13. An apparatus, as claimed in claim 12, wherein:
said fifth means includes a pair of foot members spaced from each other and said second means includes a clamping member disposed between said foot members, and wherein said clamping member is movable towards and away from the fabric relative to said foot members.

14. An apparatus, as claimed in claim 13, wherein:
said sixth means includes biasing means for use in causing said fifth means to move relative to the fabric.

15. An apparatus, as claimed in claim 14, wherein:
said biasing means includes spring means for providing movement of said fifth means toward the fabric.

16. A method for allowing a sewing needle to sew portions of a label to fabric, comprising:
connecting a projecting member to a sewing machine;
clamping the label to the fabric using a clamping member;
moving said clamping member relative to the sewing needle and said projecting member;
causing a flipper arm connected to said clamping member to move upon engagement between said flipper arm and said projecting member; and
sewing fabric portions after movement of said flipper arm.

17. A method, as claimed in claim 16, wherein:
said step of causing includes maintaining contact between said flipper arm and said projecting member during movement of said flipper arm.

18. A method, as claimed in claim 16, wherein:
said step of causing includes causing said flipper arm to move while maintaining said projecting member in a substantially stationary position.

19. A method, as claimed in claim 16, wherein:

said step of sewing includes sewing the label portions while portions of said projecting member and portions of the sewing needle are both disposed in an open area of said flipper arm.

20. A method, as claimed in claim 16, wherein:

said step of connecting includes replacing a vibrating presser foot of the sewing machine with said projecting member.

21. An apparatus which is detachably connectable to a programmable sewing machine for sewing first and second labels to first and second fabrics, respectively, in which the programmable sewing machine has an assembly for moving the labels and the fabrics along a supporting surface and relative to the sewing needle, comprising:

first means connected to the assembly for engaging the fabric;

second means for clamping each of the first and second labels at selected time to the first and second fabrics, respectively;

wherein said first and second means start from a beginning position when the first label is to be sewn to the first fabric;

connector means for joining said second means to the assembly, wherein said connector means is movable between a first position and a second position, wherein a portion of said connector means which extends the maximum distance above the supporting surface is at a first vertical distance, and wherein the maximum distance that the sewing needle is retractable above the supporting surface is to a second vertical distance which is less than said first vertical distance;

third means for positioning said connector means between said first and second positions, wherein said connector means is moved to said first position to sew portions of the first label to the first fabric while said first means and said second means are moving in a first direction and in which portions of the second label are sewn to the second fabric while said first and second means are moved to a second direction, opposite said first direction.

* * * * *